US011938392B1

(12) United States Patent
Nguyen

(10) Patent No.: US 11,938,392 B1
(45) Date of Patent: Mar. 26, 2024

(54) CONTAINER LID WITH A BARBELL JACK DEVICE AND METHOD OF USE

(71) Applicant: Gentoo LLC, Sumner, WA (US)

(72) Inventor: Peterson Nguyen, Sumner, WA (US)

(73) Assignee: GENTOO LLC, Sumner, WA (US)

( * ) Notice: Subject to any disclaimer, the term of this patent is extended or adjusted under 35 U.S.C. 154(b) by 0 days.

(21) Appl. No.: 18/490,625

(22) Filed: Oct. 19, 2023

Related U.S. Application Data

(60) Provisional application No. 63/490,504, filed on Mar. 15, 2023.

(51) Int. Cl.

| | |
|---|---|
| ***A45F 3/18*** | (2006.01) |
| ***A63B 21/072*** | (2006.01) |
| ***A63B 71/00*** | (2006.01) |
| *A45F 3/00* | (2006.01) |

(52) U.S. Cl.
CPC ..... *A63B 71/0036* (2013.01); *A45F 3/18* (2013.01); *A63B 21/0724* (2013.01); *A45F 2003/003* (2013.01)

(58) Field of Classification Search
CPC ..... A63B 71/0036; A63B 21/0724; A63B 21/072–08; A45F 3/18; A45F 2003/003
See application file for complete search history.

(56) References Cited

U.S. PATENT DOCUMENTS

| | | | | |
|---|---|---|---|---|
| 794,262 | A * | 7/1905 | Eyck | B66F 3/35 254/134 |
| 1,414,718 | A * | 5/1922 | Anglada | B66F 3/247 254/93 HP |
| 1,496,418 | A * | 6/1924 | Kahn | B66F 3/247 91/44 |
| 3,902,699 | A * | 9/1975 | Brackett | B66F 3/24 254/134 |
| 5,738,617 | A * | 4/1998 | Watson | A63B 21/078 482/104 |
| D513,819 | S * | 1/2006 | Ji | D34/31 |
| D537,605 | S * | 2/2007 | Rivera | D34/31 |
| 2009/0134375 | A1* | 5/2009 | Shi | B66F 3/245 254/93 H |
| 2011/0183818 | A1* | 7/2011 | Mitchell | A63B 71/0036 29/426.1 |

(Continued)

FOREIGN PATENT DOCUMENTS

DE 202023104294 U1 * 10/2023

*Primary Examiner* — Nyca T Nguyen
(74) *Attorney, Agent, or Firm* — KOS IP Law LLP

(57) ABSTRACT

A bar jack device incorporated with a bottle, specifically a water bottle, is disclosed. The bar jack device may be part of the bottle lid or may be a separate add-on component that may be coupled to the bottle lid. The bar jack device may have one or more grooves designed to receive the central shaft of an exercise bar and orientate such bar in different orientations. The different created orientations of the exercise bar by the bar jack device may allow a user to load or unload weight plates on the sleeves of the exercise bar. Method of use of the bar jack device incorporated with the bottle to make a bar jack assembly is also disclosed. Among other things, the method of use lifts the exercise bar and the weight plates off the ground by using the bar jack device incorporated with the bottle as a pivoting mechanism.

20 Claims, 12 Drawing Sheets

(56) References Cited

U.S. PATENT DOCUMENTS

| | | | | |
|---|---|---|---|---|
| 2015/0157894 | A1* | 6/2015 | Rulli | A63B 21/0783<br>482/104 |
| 2020/0114193 | A1* | 4/2020 | Tabone | A63B 21/0783 |
| 2021/0228966 | A1* | 7/2021 | Kleva | A63B 71/0036 |
| 2022/0339486 | A1* | 10/2022 | Cahn | A63B 21/078 |

* cited by examiner

CONTAINER LID WITH A BARBELL JACK DEVICE AND METHOD OF USE

CROSS-REFERENCE TO RELATED APPLICATIONS

This application claims priority to Prov. Pat. App. Ser. No. 63/490,504, filed on Mar. 15, 2023, the entire contents of which are expressly incorporated herein by reference.

STATEMENT RE: FEDERALLY SPONSORED RESEARCH/DEVELOPMENT

Not Applicable

BACKGROUND

The various aspects and embodiments described herein relate to a bar jack bottle assembly and a method of using thereof.

A user who wants to do weight lifting exercises may use a barbell and a plurality of weight plates. The user may need to lift the barbell off the ground to load or unload weight plates on the bar, and weight plates tend to be heavy by design.

Accordingly, there is a need in the art for an improved device, system, and method for assisting in loading and unloading weight plates on a barbell.

BRIEF SUMMARY

The various embodiments and aspects disclosed herein address the needs discussed above, discussed below and those that are known in the art.

A bar jack device incorporated with a bottle, specifically a water bottle, is disclosed. The bar jack device may be part of the bottle lid or may be a separate add-on component that may be coupled to the bottle lid. The bar jack device may have one or more grooves designed to receive the central shaft of an exercise bar and orientate such bar in different orientations. The different created orientations of the exercise bar by the bar jack device may allow a user to load or unload weight plates on the sleeves of the exercise bar. Method of use of the bar jack device incorporated with the bottle, forming a barbell jack assembly, is also disclosed. Among other things, the method of use lifts the exercise bar and the weight plates off the ground by using the bar jack device incorporated with the bottle as a pivoting mechanism.

More particularly, a method for lifting a barbell having weight plates on both sides is disclosed. The method may comprise Additionally, a bottle lid with an integrated barbell jack device is disclosed.

Furthermore, an add-on barbell jack that is attachable to a bottle lid is disclosed.

A bottom portion of the bottle may be removably engageable to a top portion of the bottle. The bottom portion of the bottle being reinforced.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
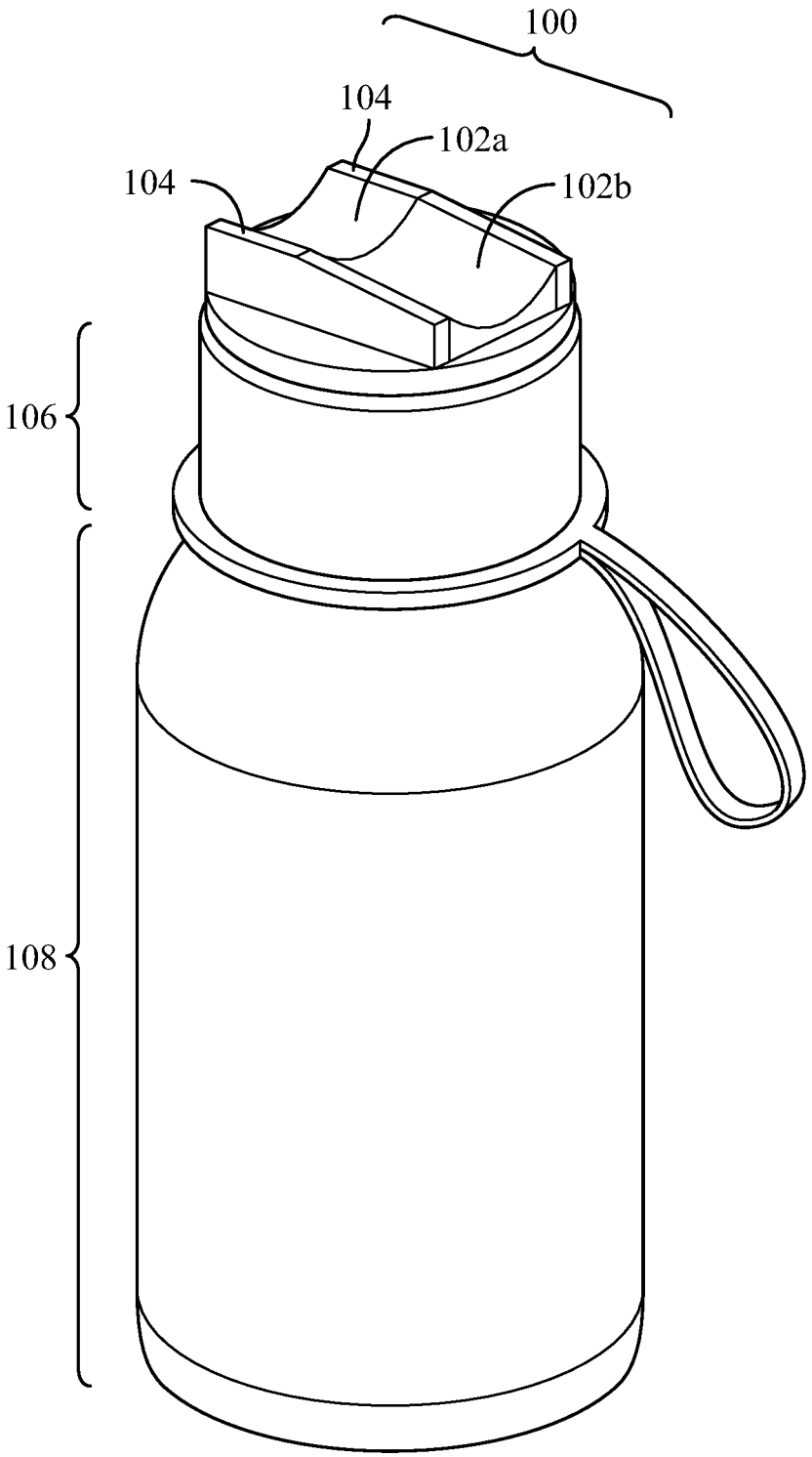
FIG. 1 shows a perspective view of a bottle having a bottle lid with a barbell jack device.
Figure 2A:
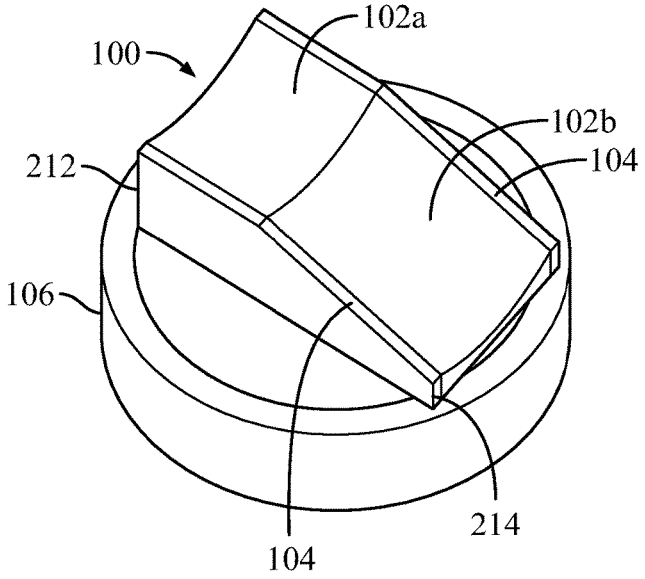
FIG. 2A shows a perspective view of a bottle lid having the barbell jack device.
Figure 2B:
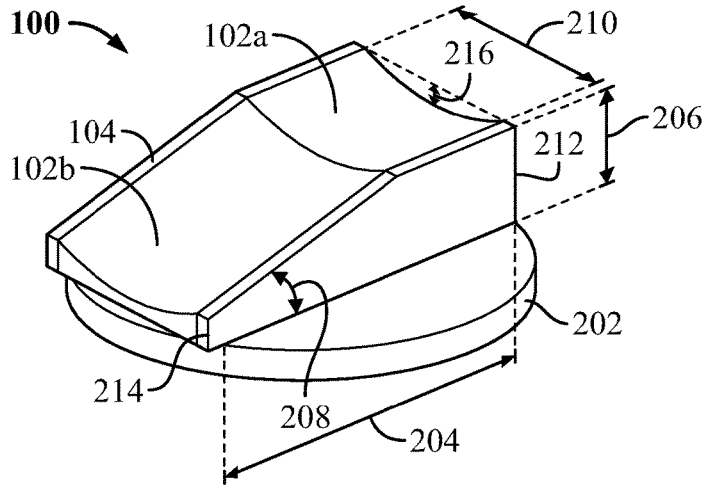
FIG. 2B shows a perspective view of the barbell jack device of FIG. 2A as a separate component from the bottle lid.
Figure 2C:
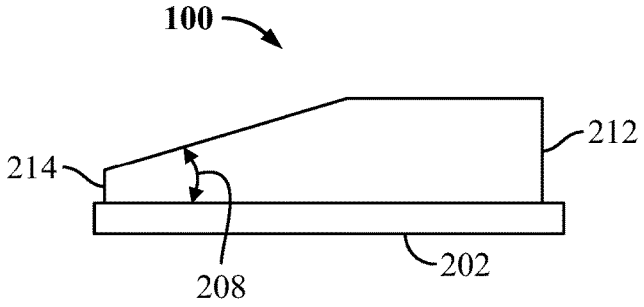
FIG. 2C shows a side view of the barbell jack device shown in FIG. 2B.
Figure 4A:
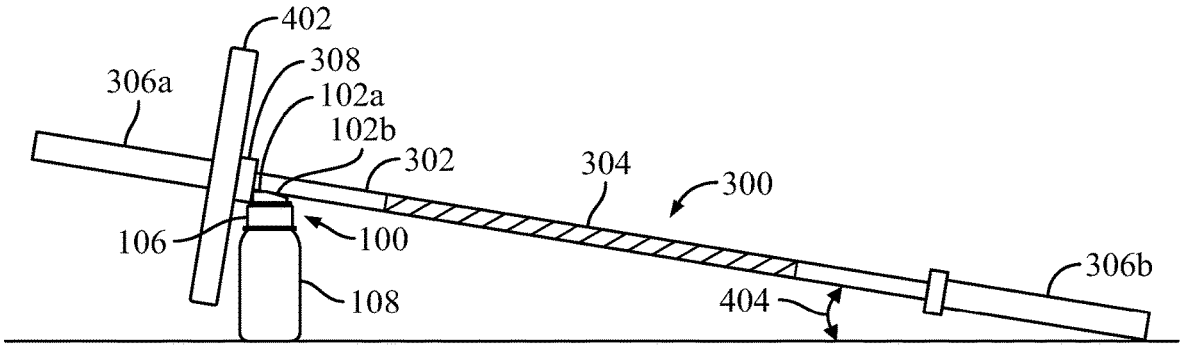
FIG. 4A shows the bottle having the barbell jack device shown in FIG. 1 orientating the barbell in a first orientation.
Figure 4B:
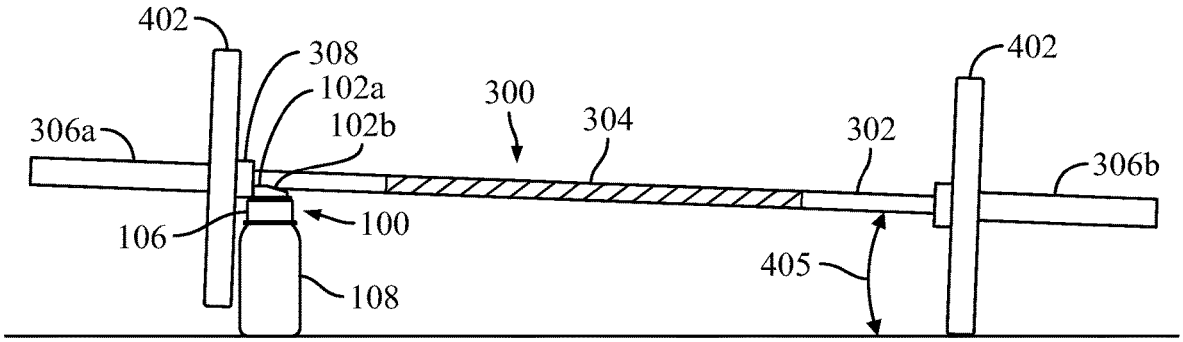
FIG. 4B shows the bottle having the barbell jack device shown in FIG. 1 orientating the barbell in a second orientation.
Figure 5:
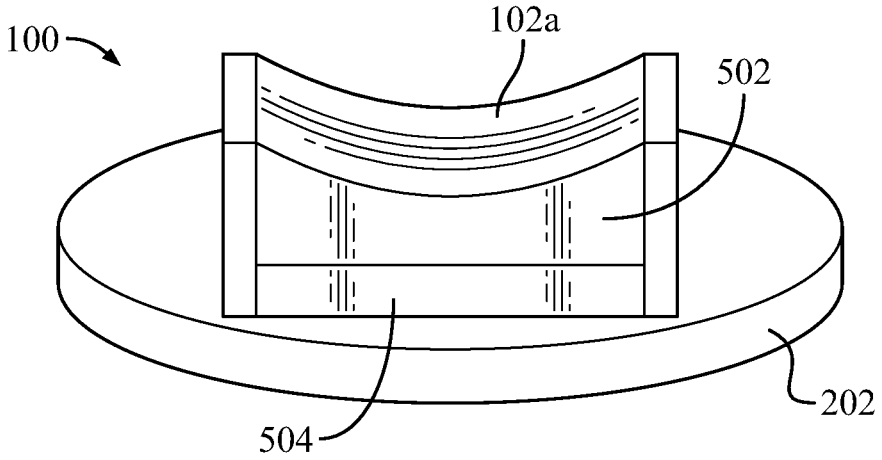
FIG. 5 shows another example of the barbell jack device.
Figure 6:
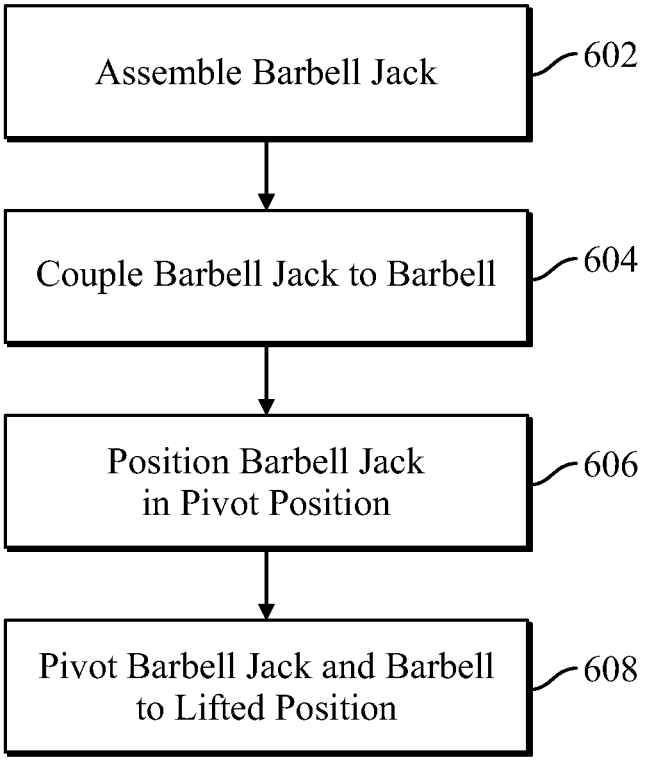
FIG. 6 shows a flow chart of a process for using the barbell jack device coupled to the bottle.
Figure 7A:
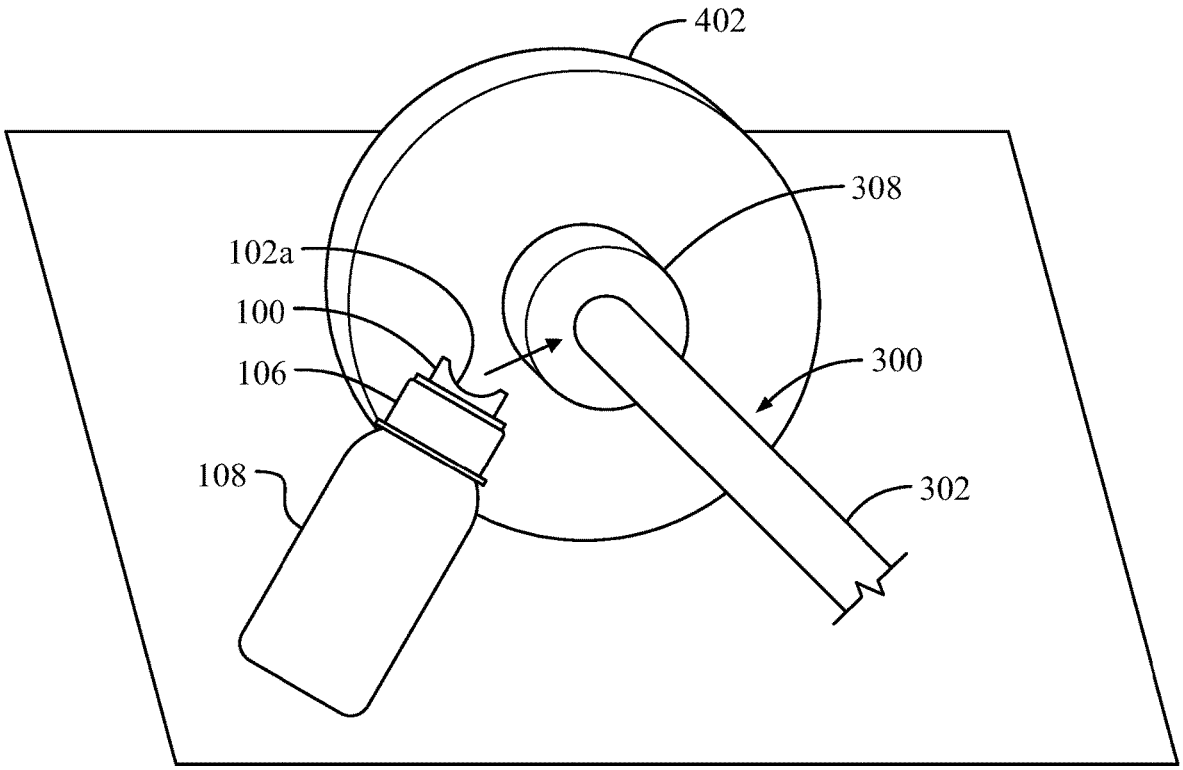
FIGS. 7A-F show the implementation of the process shown in the flow chart of FIG. 6 on a barbell having weight plates.
Figure 7B:
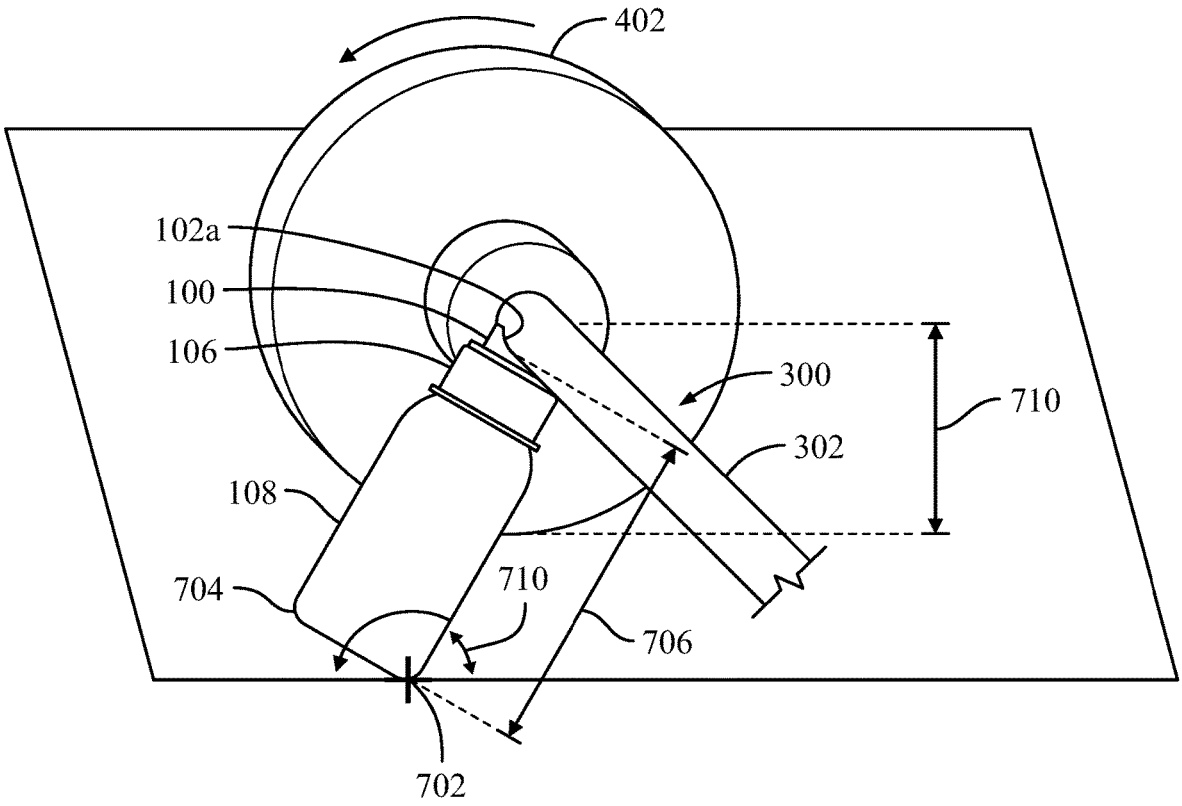
Figure 7C:
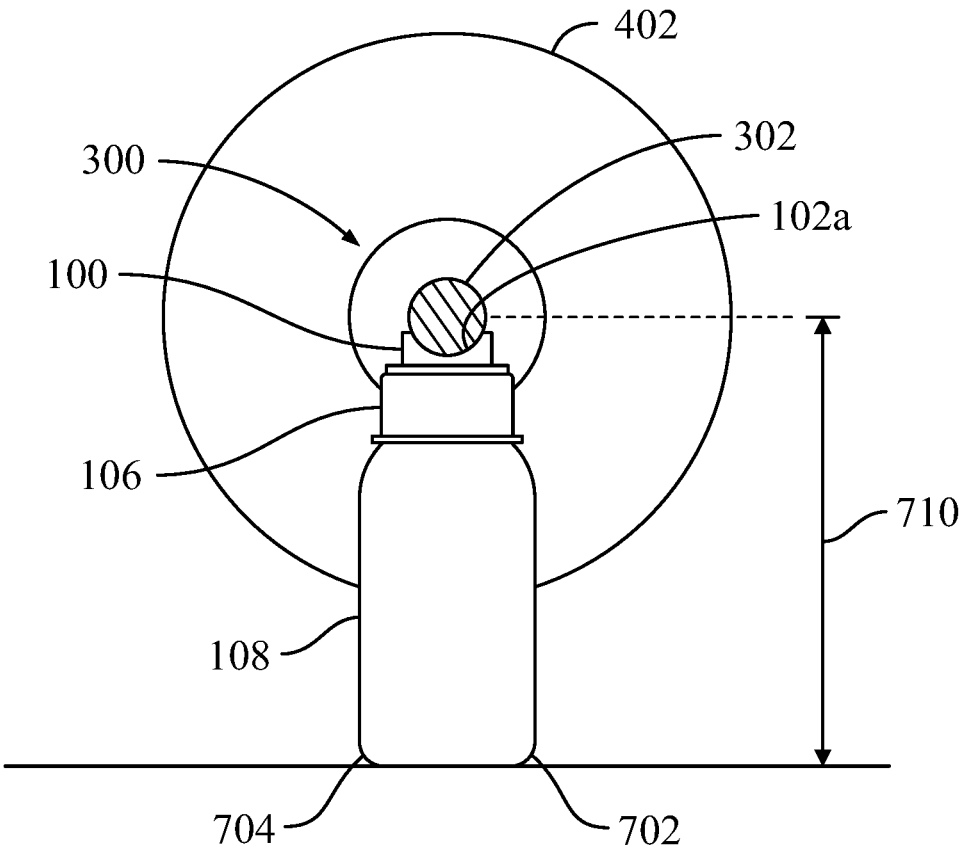
Figure 8:
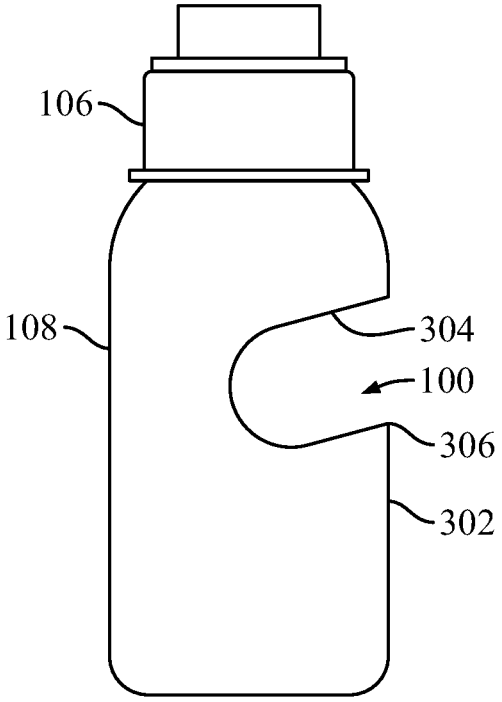
FIG. 8 shows another embodiment of a barbell jack device implemented with a bottle.

Referring now to the drawings, a barbell jack device 100 incorporated with a bottle, specifically a water bottle 108, is disclosed. As shown in FIG. 1, the barbell jack device 100 may be part of a bottle lid 106 that is coupled to the water bottle 108, which would transform the water bottle to serve as a barbell jack assembly. As shown in FIGS. 2A-C, the barbell jack device 100 may have one or more curved grooves 102*a-b* and either be integrated with the bottle lid 106 or stand as an add-on component that may be attached to the bottle lid. One of the grooves 102*a* may run horizontally along the body of the barbell jack device 100, and another groove 102*b* that is in-line with the first groove 102*a* may be inclined. The one or more grooves 102*a-b* may be configured to receive a portion of the central shaft 302 portion of the barbell 300 or the handle 314 portion of the trap bar 301 shown in FIGS. 3A-B. As such, and as shown in FIGS. 4A-B, the barbell jack device 100 may lift the barbell 300 off the ground and orientate the bar in different orientations depending on which groove 102*a-b* is receiving the central shaft 302 of the barbell 300. As shown in FIG. 5, the barbell jack device 100 may only have one groove 102*a* instead of a plurality of grooves. A process of how to effectively use the barbell jack device 100 incorporated with the bottle is disclosed herein and as shown in the flow chart of FIG. 6. The illustration of the steps in the process shown in the flow chart of FIG. 6 is shown in FIGS. 7A-C. Other embodiments of incorporating a barbell jack device 100 with a bottle are also contemplated herein, for example as shown in FIG. 8.

Although the written description refers to a barbell jack device 100, it is to be understood that the different embodiments of devices and methods disclosed herein may be used with any other type of exercise bars, such as a trap bar. Although the written description refers to the usage and incorporation of the barbell jack device 100 with a bottle lid 106, the barbell jack device 100 may be used with other parts and components of a bottle or any other devices. Additionally, a bottle lid 106 may be synonymous to a bottle cap. What is described with respect to the barbell jack device integrated with the bottle lid 106 may apply to the add-on barbell jack device 100 and vice-versa.

Referring specifically now to FIG. 1, a perspective view of a bottle 108 having a bottle lid 106 with a barbell jack device 100 is shown. The bottle lid 106 may have a cylindrical body with an undersurface opening to couple with the bottle 108. By way of example and not limitation, the top surface of the bottle lid 106 may have a barbell jack device 100. The barbell jack device 100 may have one or more curved grooves 102*a-b* configured to receive the central cylindrical shaft 302 of the barbell 300, shown in FIG. 3A, that is used by a user to grip the barbell for a weight lifting exercise. By way of example and not limitation, the plurality of curved grooves 102*a-b* may be in-line with each other to share the top edges 104 and have support surfaces with different incline angles, such as a first groove 102*a* having a horizontal support surface and a second groove 102*b* having an inclined support surface. The different angled support surfaces of the grooves 102*a-b* may be used to support the barbell in different orientations. The barbell central shaft may be placed within one of the grooves 102*a-b* and in between the top edges 104 of the barbell jack device 100.

As explained elsewhere herein, the barbell jack device 100 may be integrated with the bottle lid 106 or may be an attachable add-on component. By way of example and not limitation, the user may acquire a desired bottle 108 with a bottle lid 106 and attach the add-on barbell jack device 100 to a top surface of the bottle lid 106. By way of example and not limitation, the add-on barbell jack device 100 may be compatible with different types of bottle lids 106, such as a screw-on lid, a flip-back lid, or a flip-up straw lid. Other types of lids are also contemplated herein. By way of example and not limitation, the barbell jack device 100 may be part of the bottle lid 106 but may be separatable.

By way of example, the bottle 108 that may be used with the barbell jack device 100 may be a single wall reusable water bottle or an insulated water bottle having a double wall and a vacuum area therebetween. By way of example and not limitation, the bottle 108 may be made of a metal material, such as steel, aluminum, or a titanium alloy. In a preferred example, the bottle 108 may be made out of stainless steel. The total length of the bottle 108 and the bottle lid 106 having the barbell jack device 100 may be between 4-15 inches. Preferably, a distance from a bottom surface of the bottle to a bottom of the groove may be equal to or greater than 8 inches and equal to or less than 10.5 inches The cross-sectional diameter of the bottle 108 may be between 2-5 inches. The cross-sectional diameter of the bottle lid 106 having the barbell jack device 100 may be between 2-4 inches. Although the barbell jack device is described herein with reference to water bottles, other containers in general are also contemplated herein, such as a reusable metal coffee cup with a lid.

The bottle 108 and the bottle lid 106 having the barbell jack device 100 serve as a bar jack device. As explained further with FIGS. 3A-B, this novel bar jack device may be used by a user who wants to undertake weight lifting exercises such as deadlifts, power cleans, squat cleans, push jerks, power snatch, squat snatch, and other exercises. The user may utilize the bar jack bottle assembly to lift the barbell off the ground to load or unload weight plates to the sleeves of the barbell.

Referring now to FIG. 2A-C, the barbell jack device 100 is shown in detail. The barbell jack device 100 may essentially be a support structure with at least one groove 102*a-b* that receives and lifts up the central shaft 302 of the barbell 300 (see FIGS. 4A-B). By way of example and not limitation, the barbell jack device 100 may be integrated or detachable from the bottle lid 106. The barbell jack device 100 may be integrated with the top surface of the bottle lid 106, as shown in FIG. 2A, or be an add-on component, as shown in FIG. 2B, that may be coupled and attached to the top surface of the bottle lid 106. By way of example and not limitation, the integrated barbell jack device 100 of FIG. 2A may have essentially the same features as the add-on barbell jack device 100 of FIG. 2B, and vice versa. By way of example and not limitation, the add-on component, shown in FIG. 2B, may have the barbell jack device 100 formed on a base foundation 202. The base foundation 202 that has the support structure of the barbell jack device 100 may then be attached to the top surface of the bottle lid 106. By way of example and not limitation, the base foundation 202 may be disk-shaped, rectangular-shaped, or other shapes that allow for precise fitting and attachment on the bottle lid 106. By way of example and not limitation, the base foundation 202 having the barbell jack device 100 may be attached to the top surface of the bottle lid 106 using an adhesive compound, fasteners, magnets, or an interlocking or latching mechanism. By way of example and not limitation, the support structure of the barbell jack device 100 that is on the base foundation 202 (see FIG. 2B) may be detachable from the base foundation 202.

As shown in FIG. 2A, the barbell jack device 100 may be a support structure with one or more curved grooves 102*a-b* that are in-line with each other and are in between two top edges 104. The curved grooves 102*a-b* may each have curved surfaces to receive the central shaft of the barbell. The curved grooves 102*a-b* may be connected to each other along a continuous line that may be curved and extend along a structure length 204 of the barbell jack device 100 (see FIG. 2B) between a first end edge 212 and a second end edge 214. By way of example and not limitation, a first curved groove 102*a* may extend horizontally from the first end edge 212 towards the second curved groove 102*b*. By way of example and not limitation, the second curved groove 102*b* may incline downward from the first curved groove 102*a* towards the second end edge 214 of the barbell jack device 100. Because of the incline of the second curved groove 102*b*, the first end edge 212 may be longer than the second end edge 214. Alternatively, the barbell jack device 100 may not have a second edge 214 and the second groove 102*b* may incline all the way downwards to the base foundation 202. By way of example and not limitation, the support structure of the barbell jack device 100 may have a trapezoidal longitudinal cross section along the structure length 204 of the barbell jack device 100 (see FIG. 2C).

By way of example and not limitation, the curved grooves 102*a-b* may be parabolic, U-shaped, V-shaped, or semi-circle shaped. Alternatively, the grooves 102*a-b* may have flat contact surfaces instead of curved surfaces. By way of example and not limitation, the flat contact surfaces of the grooves 102*a-b* may be made from a flexible and elastic material, such as a plastic form, that change shape and conform to the contours of the barbell shaft when placed on such flat contact surfaces. In the same example, the flexible surface may be convex and extend outward, instead of being flat, to prevent over-bending the contact surfaces. By way of example and not limitation, the flat or concave contact surfaces of the grooves 102*a-b* may be made from a substantially rigid material and a spring mechanism may be placed under such contact surfaces to allow the gradual lowering of such contact surfaces when the barbell shaft is placed on them and provide an upward restoring force when the barbell shaft is removed.

As shown in FIG. 2B, the structural dimensions of the barbell jack device 100 are shown. By way of example and not limitation, the height of the first end edge 212, denoted by vertical line 206, may be between 0.2 to 1.25 inches, and the height of second end edge 214 may be between 0.1 to 0.6 inches. By way of example and not limitation, an incline angle 208 of the second groove 102*b* measured from the second end edge 214 may be between 6 to 45 degrees. By way of example and not limitation, the width of grooves 210 measured from one top edge 104 to the other top edge 104 may be between 0.75 to 1.5 inches. By way of example and not limitation, the depth 216 of the grooves may be between 0.1 to 0.9 inches. By way of example and not limitation, the depth 216 of the grooves may be smaller than the width of grooves 210. Alternatively, the depth 216 of the grooves may be larger than the width of the grooves 210. By way of example and not limitation, the structure length 204 of the barbell jack device 100 may be between 0.9 to 3.75 inches. By way of example and not limitation, the length of the two grooves 102*a-b* may be equally divided along the structure length 204, or the length of the second groove 102*b* may be bigger than the first groove 102*a* by at least 1.25 times. Alternatively, the length of first groove 102*a* may be bigger than the second groove 102*b* by at least 1.25 times. These structural dimensions should be taken as non-limiting and other structural dimensions are contemplated herein.

The add-on component or the bottle lid 106 having the barbell jack device 100 may be manufactured in various ways using different materials. By way of example and not limitation, the add-on component or the bottle lid 106 having the barbell jack device 100 may be manufactured by injection molding, 3D printing, extruder, mill, lathe, or stamping die. By way of example and not limitation, the add-on component or the bottle lid 106 having the barbell jack device 100 may be made from a polymer material. The polymer material may be silicone, nylon 6 or 66, thermoplastic such as thermoplastic polyolefin, carbon fiber, polypropylene, or polystyrene. By way of example and not limitation, the add-on component or the bottle lid 106 having the barbell jack device 100 may be made from a metallic material. The metallic material may be steel, aluminum, or a titanium alloy. In a preferred example, the metallic material may be stainless steel. By way of example and not limitation, the add-on component or the bottle lid 106 having the barbell jack device 100 may be made from a composite material. The composite material may be polypropylene with a certain percentage of fiber glass. The percentage of fiber glass incorporated with the polypropylene material may range between %15 to %45.

Figure 3A:
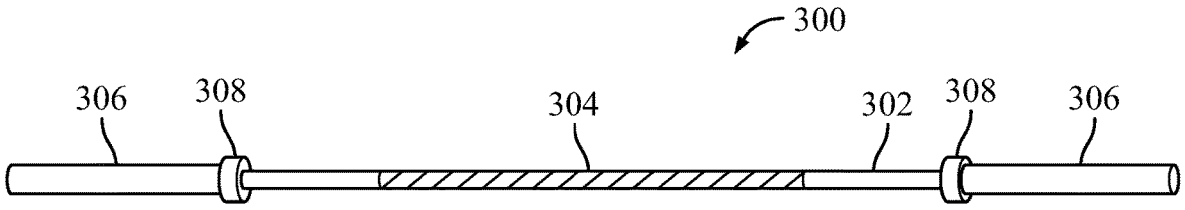
FIG. 3A shows a perspective view of a barbell.
Figure 3B:
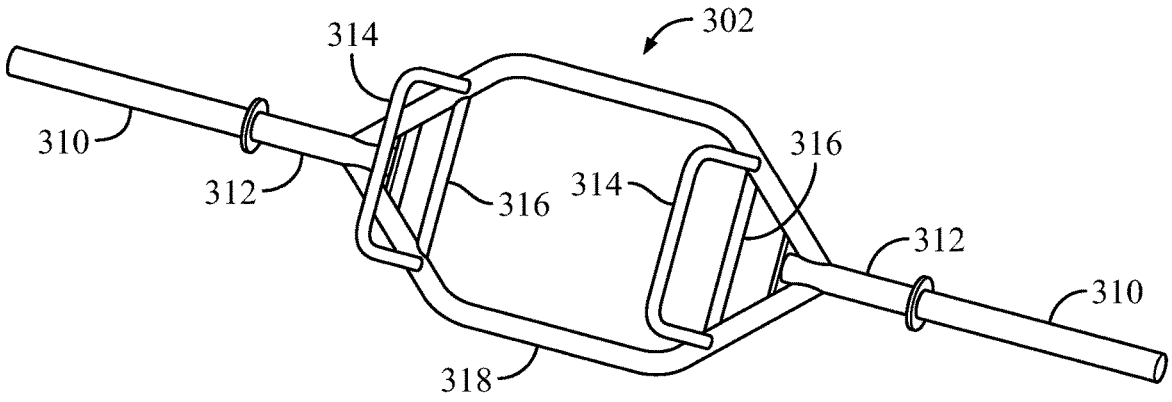
FIG. 3B shows a perspective view of a trap bar.

Referring to FIGS. 3A-B, different types of exercise bars are shown that may be used with the barbell jack device 100. FIG. 3A shows a conventional barbell 300 used for weight lifting exercises such as deadlifts, power cleans, squat cleans, push jerks, power snatch, squat snatch, and other exercises. By way of example and not limitation, the barbell shown in FIG. 3A may be a powerlifting barbell or an Olympic barbell, which these types may differ somewhat from a conventional barbell 300. The barbell 300 may be cylindrical shaped having a central shaft 302 between two cylindrical sleeves 306 with collars 308 on the ends connecting to the central shaft 302. The central shaft 302 may be used for gripping the barbell 300 for the weight lifting exercise and may have one or more knurling patterns 304 near the middle of the central shaft 302. The sleeves 306 may be thicker than the central shaft 302 and be used to load weight plates. The collars 308 of the sleeves 306 may stop the weight plates from sliding onto the central shaft 306. The sleeves 306 may spin around a longitudinal axis of the barbell 300. As described elsewhere herein, the barbell jack device 100 may be used to lift up the barbell 300 using the central shaft 306 to load or unload weight plates onto the sleeve 306 that is elevated further off the ground.

FIG. 3B shows a trap bar 301 that the barbell jack device 100 (see FIG. 1) may also be configured to lift up. The trap bar 301 may have a rectangular ring body 318 that may surround the person using the trap bar 301. The rectangular ring body 318 may have two cylindrical shafts 312 with weight sleeves 310 extending from the left and right side edges of the ring body. The weight sleeves 310 may be used for loading and unloading weight plates. The trap bar 301 may have two gripping handles 314 attached within the interior of the rectangular ring body 318 and running perpendicular to the cylindrical shafts 312. Each handle 314 may have a lower section 316 on the same level as the cylindrical shafts 312. The barbell jack device 100 may be placed under the lower section 316 of the handle 314 to lift up the trap bar 301 and load and unload weight plates onto the weight sleeve 310. The barbell jack device 100 may also be used with a curl bar (not shown).

Referring to FIGS. 4A-B, the bottle 108 having the barbell jack device 100 is shown orientating the barbell 300 in different orientations. The first and second curved grooves 102*a-b* of the barbell jack device 100 may be used to lift up one longitudinal side of the barbell relative to the other side to load and unload weight plates 402 to the sleeve 306 of the lifted side. As shown in FIG. 4B, the first curved groove 102*a* may be used to lift up one side of the barbell when the other side has weight plates 402 already loaded. As show in FIG. 4A, the second curved groove 102*b* may be used to lift up one side of the barbell when the other side does not have any weight plates 402 loaded.

Referring specifically to FIG. 4A, the barbell jack device 100 is shown orientating the barbell 300 in a first orientation. In this first orientation, the central shaft 302 of the barbell 300 may rest on the second curved groove 102*b* of the barbell jack device 100 that is inclined. The second curved groove 102*b* that is inclined, as described elsewhere herein, may be used when the second sleeve 306*b* opposite to the first sleeve 306*a* that is being lifted has no weight plates 402 loaded. The second sleeve 306*b* may be empty because such sleeve may be the subsequent sleeve to be loaded after the first sleeve 306*a*, or the second sleeve 306*b* may be empty because such sleeve may be coupled to a T-bar row mechanism. The T-bar row mechanism may be implemented when the user would like to undertake landmine exercises.

By placing the barbell jack device 100 under the central shaft 302 of the barbell 300 and utilizing the incline of the second curved groove 102*b* to elevate the central shaft 302, the first sleeve 306*a* closest to the barbell jack device 100 may be lifted up relative to the opposite second sleeve 306*b*, and also the ground, to allow for simple loading and unloading of weight plates 402. The barbell angle of incline 404 of the first sleeve 306*a* created by the second curved groove 102*b* may be adjusted by moving the bottle 108 having barbell jack device 100 closer or farther from the collar 308 of the first sleeve 306*a* that is lifted. By moving the barbell jack device 100 farther from the collar 308 of the first sleeve 306*a*, the barbell angle of incline 404 increases. However, it may be preferred to place the barbell jack device 100 close to the collar 308 of the first sleeve 306*a* to avoid the seesawing of the barbell 300.

Referring specifically to FIG. 4B, the barbell jack device 100 is shown orientating the barbell 300 in a second orientation. In this second orientation, the central shaft 302 of the barbell 300 may rest on the first curved groove 102*a* of the barbell jack device 100 that is horizontal. The first curved groove 102*a* that is horizontal, as described elsewhere herein, may be used when both the first sleeve 306*a* to be lifted and the opposite second sleeve 306*b* have loaded weight plates 402. Manually holding the first sleeve 306*a* may be cumbersome since such sleeve 306*a* has loaded weight plates 402. Consequently, a user may implement the barbell jack device 100, specifically the first curved groove 102*a*, to elevate the first sleeve 306*a* and its loaded weight plates 402 off the ground. Since the first curved groove 102*a* is horizontal, the lifted first sleeve 306*a* and its weight plates 402 will be elevated off the ground depending on the height of the bottle 108 holding the barbell jack device 100 under the central shaft 302 of the barbell 300. The dimensions of the bottle 108 and the bottle lid 106 having the barbell jack device 100 are described elsewhere herein. By creating such elevation of the lifted first sleeve 306*a*, the barbell 300 may be slightly inclined at second barbell angle 405, as shown in FIG. 4B. Alternatively, the first sleeve 306*a* may not initially have any weight plates 402 loaded and only the second sleeve 306*b* may have weight plates loaded 402. By way of example and not limitation, the first curved groove 102*a* of the barbell jack device 100 may contact the portion of the central shaft 302 proximate to the collar 308 of the first sleeve 306*a*. By way of example and not limitation, the first curved groove 102*a* of the barbell jack device 100 may contact the knurling pattern 304 of the central shaft 302 to help provide more frictional force and prevent the barbell 300 from sliding off the barbell jack device. A novel method of elevating the first sleeve 306*a* using the barbell jack device 100 is described elsewhere herein.

The barbell jack device 100 may also be used to lift a trap bar 301 that is shown in FIG. 3B. Either the first or second groove 102*a-b* of the barbell jack device 100 may receive the lower section 316 of the handle 314 (see FIG. 3B) to lift up the trap bar 301 to allow for the loading and unloading of weight plates onto the weight sleeve 310. Such process may occur similar to what has been described with respect to the barbell 300 elsewhere herein.

Referring now to FIG. 5, another example of the barbell jack device 100 is shown. Specifically, the barbell jack device 100 may have one curved groove 102*a* that runs horizontally along the length of the barbell jack device 100. The example of the barbell jack device 100 shown in FIG. 5 may be integrated with the bottle lid 106 or be an add-on component, as explained elsewhere herein. By way of example and not limitation, the add-on component of the barbell jack device 100 may have a base foundation 202 with the support structure, which has the first curved groove 102*a*, formed on top of such base foundation 202. By way of example and not limitation, the first curved groove 102*a* may be parabolic, U-shaped groove, V-shaped, semi-circle shaped. The structural dimensions of the first curved groove 102*a* may be similar as to what has been described elsewhere herein.

By way of example and not limitation, the first curved groove 102*a* may have an upper portion 502 and a lower portion 504 that are separable and modular from each other. By way of example and not limitation, the upper portion 502 may be made of a flexible material and the lower portion 504 may be made of a material that is more rigid than the flexible material of the upper portion. By way of example and not limitation, the upper portion 502 may be made of a plastic foam material and the lower portion may be made of a polymer material that is mentioned elsewhere herein. Alternatively, the lower portion 504 may be made of a flexible material and the upper portion 502 may be made of a material that is more rigid than the flexible material of the lower portion 504. The difference in hardness of the upper portion 502 and the lower portion 504 may be needed to allow the first curved groove 102*a* to descend downwards as the central shaft 302 of the barbell 300 (see FIG. 3A) is rested upon the first curved groove 102*a*. Also, the difference in hardness may provide a restoring force for the first curved groove 102*a* to return to its original position once the central shaft 302 is removed from the first curved groove 102*a*. By way of example and not limitation, the lower portion 504 may be a spring mechanism that allows the descending of the upper portion 502 and also provide a restoring force to restore the upper portion 502 to its original position.

Referring now to FIG. 6, a flow chart of a process for using the barbell jack device 100 coupled to the bottle 108 is shown. FIGS. 7A-C show the implementation of the process shown in the flow chart of FIG. 6 on a barbell 300 having weight plates 402. The process shown in the flow chart of FIG. 6 may orientate the barbell 300 similar to what is shown in FIG. 4B, where the first sleeve 306*a* having weight plates 402 is elevated from the ground and relative to the opposite second sleeve 306*b*, which may also have weight plates 402 loaded.

In block 602, the process assembles the barbell jack assembly that is to be used in lifting up the barbell 300. The bottle 108 shown in FIG. 7A may be coupled to the bottle lid 106 that has the barbell jack device 100. By way of example and not limitation, the bottle lid 106 may have an integrated barbell jack device 100, as described elsewhere herein. By way of example and not limitation, the barbell jack device 100 may be an add-on component that gets attached to a top surface of a regular bottle lid 106, as described elsewhere herein. The bottle 108, the bottle lid 106, and the barbell jack device 100 may each have the same features disclosed elsewhere herein.

In block 604, the process couples the barbell jack assembly to the barbell 300. As shown in FIGS. 7A-B, the first curved groove 102*a* of the barbell jack device 100 may contact and receive the central shaft 302 of the barbell 300. Specifically, and by way of example and not limitation, the first curved groove 102*a* may contact and receive the left or right side of the arc surface of the central shaft 302 and be rotated under the central shaft 302 at a pivot position, as explained elsewhere herein. By way of example and not limitation, the first curved groove 102*a* may contact the longitudinal side of the central shaft 302 that has the sleeve and the weight plate 402 to be lifted. By way of example and not limitation, the first curved groove 102*a* may contact the portion of the central shaft 302 next to the collar 308 of the first sleeve 306*a* (see FIG. 4B) to be lifted or, alternatively, contact the knurling pattern of the central shaft 302 for more frictional force.

In block 606, the process positions the barbell jack assembly in a pivot position. As shown in FIG. 7B, the bottle 108 having the barbell jack device 100 with the first groove 102*a* contacting the central shaft 302 may be rotated towards the ground such that a first bottom edge 702 of the bottle 108 that is horizontally closest to the central shaft 302 of the barbell 300 is contacting the ground and a second bottom edge 704 opposite to the first bottom edge 702 is elevated and in the air. At this pivot position, the barbell jack device 100 along with the bottle 108 are substantially under and to the side of the central shaft 302 of the barbell 300, where the longitudinal side of the barbell 300 that is to be lifted has weight plates 402 contacting the ground. By way of example and not limitation, the bottle 108 and the barbell jack device 100 may be static at the pivot position, where the contact force of the central shaft 302 on the first groove 102*a*, the contact force of the ground on the first bottom edge 702, and the weight force of the bottle 108 having the barbell jack device 100 are balanced.

Alternatively, positioning the barbell jack assembly in the pivot position may be described as wedging the barbell jack assembly between the barbell 300 and a ground surface wherein a distance 706 between a first contact point and a second contact point is greater than a first height distance 708 of the barbell 300 to the ground surface, the first height 708 defined by a radius of the weight plate 402 separating the barbell central shaft 302 from the ground. The first contact point may be defined by the barbell jack assembly and the barbell 300, specifically the contact point of the first groove 102*a* and the barbell center shaft 302. The second contact point may be defined by the barbell jack assembly and the ground surface, specifically the contact point between the first bottom edge 702 and the ground.

By way of example and not limitation, a pivot angle 710 may be formed at the first bottom edge 702 when the bottle 108 is at the pivot position. The pivot angle 710 may be measured between the ground and the side of the bottle 108 having the first bottom edge 702. When the pivot angle 710 is large, the user may need to apply less force to rotate the barbell 300 since the bottle 108 and the barbell jack device 100 would provide greater leverage in lifting up the barbell when the pivot angle is large 710. By way of example and not limitation, the pivot angle 710 may range from 45 to 80 degrees. Achieving the desired pivot angle 710 may depend on the length of the water bottle since such length determines in-part how far the bottle 108 and the barbell jack device 100 may be placed under the barbell central shaft 302. By way of example and not limitation, the distance 706 between the first groove 102*a* and a bottom surface of the first bottom edge 702 may range from 7 to 12 inches. More particularly, the distance 706 may be between 8 to 10.5 inches.

Figure 7D:
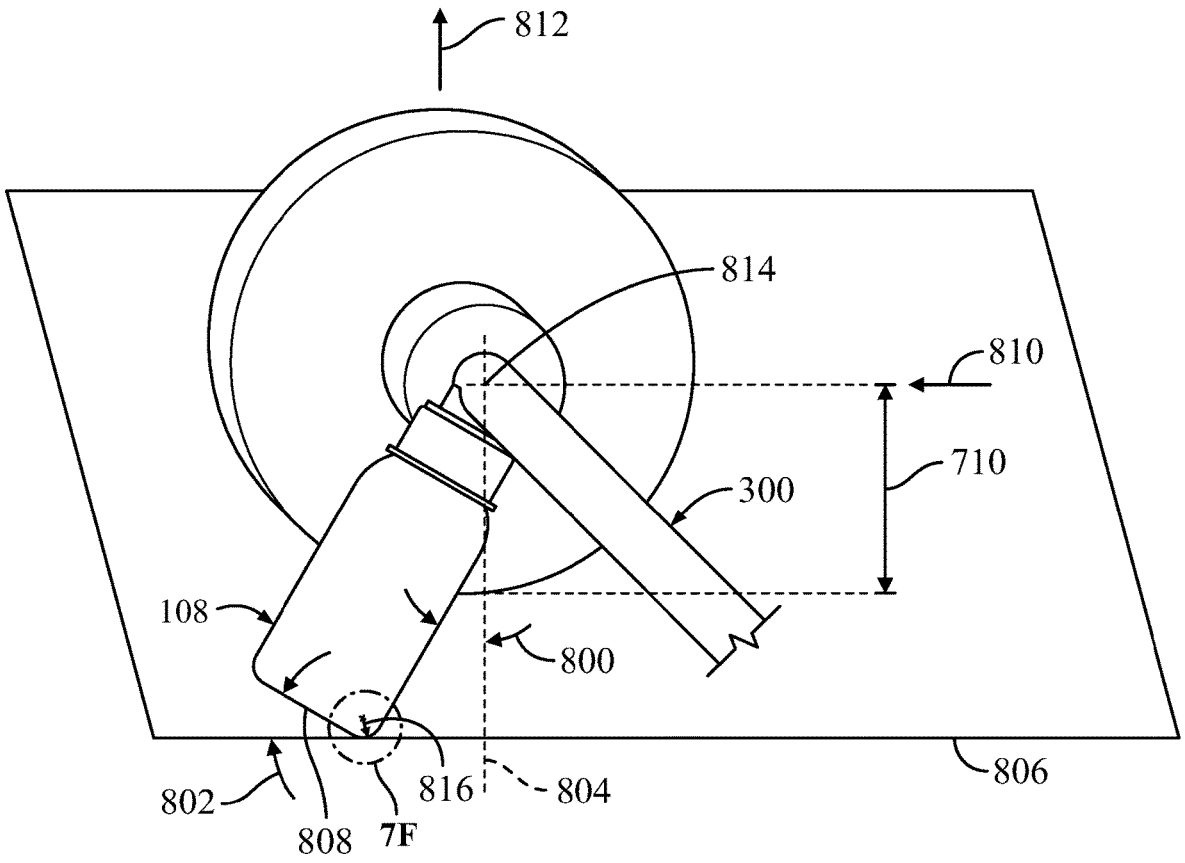

In another aspect, when the bottle 108 in the position shown in FIG. 7D, two resultant-effective variables that serve as a function are shown. The first is angle 800 and the second is a critical tipping angle 802. When the bottle 108 is coupled to the barbell 300, it creates a right triangle with the bottle 108 being the longest side or hypotenuse. The dash line 804 being one side of the right triangle and the ground or ground surface 806 being the other side of the right triangle. The angle between the bottom surface 808 of the bottle 108 and the ground 806 may define a critical tipping angle. When the user pulls the barbell 300 to the left horizontally in direction of arrow 810, the lesser the angle 800, the less force the user has to apply in the direction 810 in order to pivot the barbell upward. Note that all the force needed in the up direction 812 is done by the bottle 108 so the user does not have to lift the bottle 108 upwards. For example, when there is 100 lbs of downward weight acting on the bottle 108 and the angle 800 is 45 degrees, then the user has to apply 70 lbs of force in the direction 810 while the bottle 108 is applying 70 lbs of force in the direction 812 in order to pivot the barbell upward into the position shown in FIG. 7C. However, when there is 100 lbs of weight acting on the bottle and angle 800 is 20 degrees, then the user only has to apply 34 lbs of force in the 810 direction while the bottle is applying 93 lbs of force in the direction 812 in order to pivot the barbell 108 to the position shown in FIG. 7C.

The second variable is the critical tipping angle 802 which is the degree in which the coupled bottle 108 and barbell 300 or center of gravity 814 of the barbell 108 including the weights is over the edge 702 before the barbell 300 will fall to the upright position (see FIG. 7C) on its own. That calculation is done in relation to the radius 816 of the base (i.e., bottom end portion of the bottle 108) and the height 710 to the barbell (angle=tan−1(r/h)). The greater the tipping angle 802, the less distance the bottle 108 has to pivot before the user no longer has to apply force. In relation to the two result effective variables, the angle 800 is equal or less than 40 degrees and also greater than or equal critical tipping angle 802. Preferably, the critical tipping angle is greater than or equal to 9 degrees.

Figure 7E:
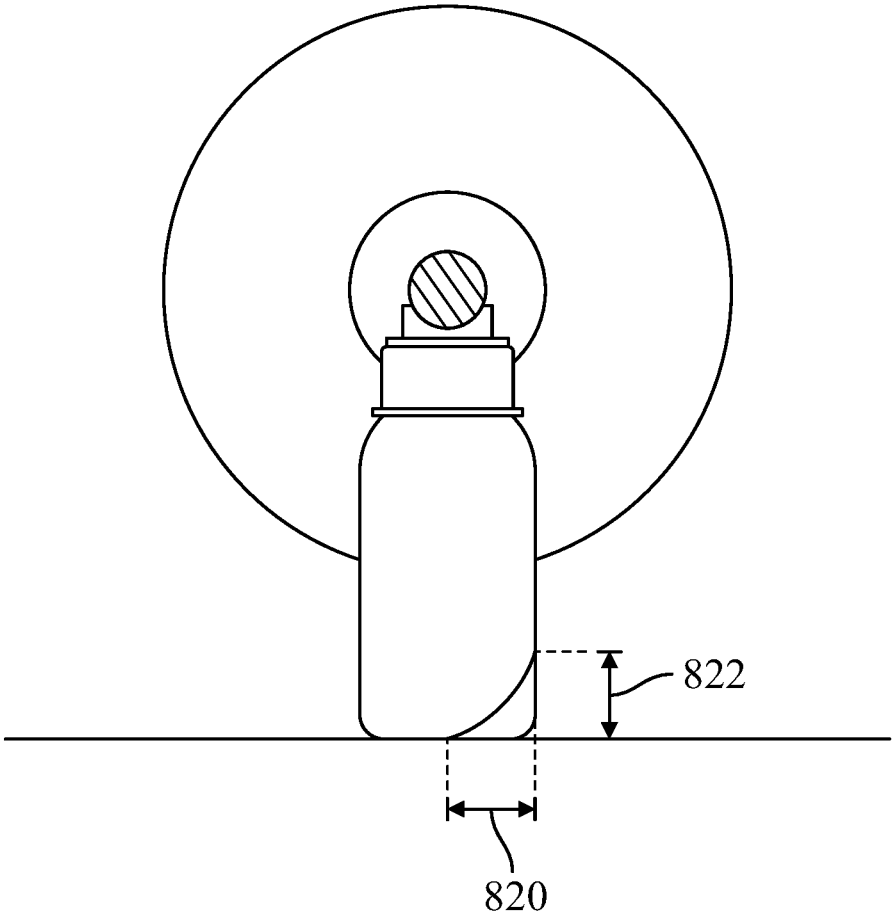
Figure 7F:
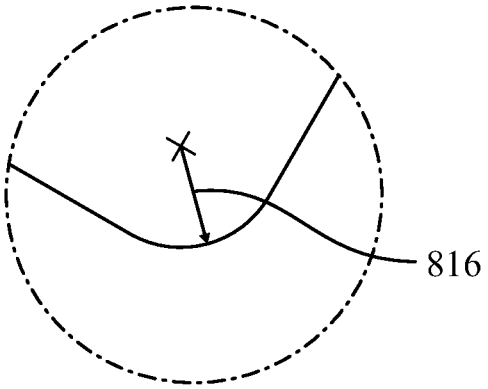

Alternatively, instead of a large radius 816, a smaller radius could be used along with chamfer 818. See FIG. 7E. A chamfer width 820 may be equal to or less than 1.4 inches or equal to or greater than 0.2 inches. A chamfer height 822 may be equal to or less than 1.4 inches or equal to or greater than 0.2 inches. The upper and lower ends of the chamfer may have a radius between or equal to 1.4 inches and 0.2 inches.

In block 608, the process pivots the barbell jack assembly and the barbell to a lifted position, as shown in FIG. 7C. As shown in FIGS. 7B and 7C, a rotational force may be applied to the bottle 108, the barbell 300, or both to transition the weight plates 402 from a grounded position to a lifted position. By way of example and not limitation, a user may need to use both hands to grip the bottle 108 having the barbell jack device 100 and the central shaft 302 of the barbell 300 in rotating the system in a lifted position. The bottle 108 having the barbell jack device 100 may pivot the central shaft 302 and the barbell 300, in general, using the first bottom edge 702 as the pivot point such that the longitudinal side of the barbell 300 closest to the barbell jack device 100 is raised to a lifted position, as shown in FIG. 4B. At the lifted position, the second bottom edge 704 along with the rest of the bottom portion of the bottle 108 contact the ground while the weight plate 402 is lifted off the ground due to the central shaft 302 being lifted by the bar jack device 100, which such lifting may be at an incline.

Alternatively, the pivoting of the barbell jack assembly and the barbell may be described as while maintaining a position of the first contact point (i.e., contact point between the first groove 102*a* and the barbell center shaft 302), rotating the barbell jack assembly and the barbell 300 around the second contact point (i.e., contact point of first bottom edge 702 with the ground) to lift the barbell to a second height 710 (see FIG. 7C) greater than the first height 708 (see FIG. 7B), the first height 708 defined by a radius of the weight plate 402. By way of example and not limitation, the second height 710 may approximately equal to the distance 706 between a first contact point and a second contact point shown in FIG. 7B.

Depending on the weight that the barbell jack assembly is lifting, the first bottom edge 702 of the bottle 108 may deform due to most of the force being directed towards such edge during the lifting of the barbell 300. By way of example and not limitation, the bottom of the bottle 108 having the first bottom edge 702 and the second bottom edge 704 may be covered by a sleeve. The sleeve may be thicker than the walls of the bottle 108 and be made out of metallic material, such as a steel or titanium alloy. Alternatively, the contours of the first bottom edge 702 may have a larger surface area contacting the ground to distribute the force over a wider area. By way of example and not limitation, the bottom edge may have a radius of 1.4 inches or greater.

Referring to FIG. 8, another embodiment of a barbell jack device 100 implemented with a bottle 108 is shown. A curved body groove 304 may be integrated in the bottle side 302 of the bottle 108 instead with the bottle lid 106. The curved body groove 304 may have the same functions to lift up a barbell 300, as explained elsewhere herein. The curved body groove 304 may have the same structural features as described elsewhere herein. In a preferred example, the curved body groove 304 may be C-shaped with the outer body rims 306 connecting to the body side 802 of the bottle 108. By way of example and not limitation, the curved body groove 304 may be angled at an incline going downward from the outer body rims 306 towards the center of the bottle 108. Such incline may prevent the central shaft 302 of the barbell 300 (see FIG. 3A) from slipping out when inserted inside the curved body groove 304. Alternatively, the curved body groove 304 may not be inclined such that the side walls of the groove are horizontal.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method for lifting a barbell to remove or add weight plates to an end portion of the barbell, the method comprising:

assembling a barbell jack assembly by coupling a bottle to a bottle lid having a barbell jack device;

wedging the barbell jack assembly between the barbell and a ground surface wherein a distance between a first and a second contact points is greater than a first height distance of the barbell to the ground surface, the first contact point defined by the barbell jack assembly and the barbell, the second contact point defined by the barbell jack assembly and the ground surface, and, the first height distance defined by a radius of the weight plate;

while maintaining a position of the first contact point, rotating the barbell jack assembly and the barbell around the second contact point to lift the barbell to a second height distance greater than the first height distance; and removing or adding weight plates to the end portion of the barbell.

2. The method of claim 1, wherein the barbell jack assembly is wedged between the ground surface and a central shaft of the barbell next to a collar of a weight plate sleeve.

3. The method of claim 1, wherein the barbell jack assembly is wedged between the ground surface and a knurling surface of a central shaft of the barbell.

4. The method of claim 1, wherein the first contact point defined by the barbell jack assembly and the barbell is defined by a support surface of a first groove of the barbell jack device and a barbell center shaft.

5. The method of claim 1, wherein the barbell jack device of the bottle lid is detachable from the bottle lid.

6. The method of claim 1, wherein by wedging the barbell jack assembly between the barbell and the ground surface the barbell jack assembly is at a static position.

7. A barbell jack for lifting a barbell to remove or add weight plates to an end portion of the barbell, the barbell jack comprising:

a bottle with a hollow interior, a bottom portion of the bottle being reinforced for withstanding weight of the barbell and a weight loaded onto the barbell, and a threaded top portion, the bottom portion of the bottle having a radius equal to or greater than 1.4 inches; and a lid having threads formed thereon for removable engagement with the threaded top portion of the bottle, the lid comprises a barbell support structure having a groove with a radius sized and configured to receive a barbell;

wherein a distance from a bottom surface of the bottle to a bottom of the groove is equal to or greater than 8 inches and equal to or less than 10.5 inches.

8. The barbell jack of claim 7 wherein the reinforced bottom portion is a sleeve that extends over the bottom portion of the bottle.

9. The barbell jack of claim 7 wherein the reinforced bottom portion is fabricated from a material which is stronger than an upper portion of the bottle.

10. The barbell jack of claim 7 wherein the reinforced bottom portion is thicker compared to an upper portion of the bottle.

11. The barbell jack of claim 7 wherein a thickness of the reinforced bottom portion is greater than or equal to 0.016 inches and less than or equal to 1 inch.

12. The barbell jack of claim 7 wherein the groove further comprises first and second grooves, the first groove in-line with the second groove, the first groove having a first support surface extending horizontally from a first end edge of the barbell support structure towards the second groove, and the second groove having a second support surface inclining downwards from the first support surface of the first groove and towards a second end edge of the barbell support structure.

13. The barbell jack of claim 12, wherein the first groove is greater than or equal to 6 degrees and less than or equal to 12 degrees skewed from the second groove.

14. The barbell jack of claim 7, wherein the first groove has a depth that is shorter than a width of the first groove.

15. The barbell jack of claim 7, wherein the second groove has a depth that is shorter than a width of the second groove.

16. The barbell jack of claim 7, wherein a side of the bottom portion is chamfered.

17. The barbell jack of claim 7, wherein a chamfer width is equal to or less than 1.4 inches or equal to or greater than 0.2 inches, and a chamfer height is equal to or less than 1.4 inches or equal to or greater than 0.2 inches.

18. A method for lifting a barbell to remove or add weight plates to an end portion of the barbell, the method comprising:

assembling a barbell jack assembly by coupling a bottle to a bottle lid having a barbell jack device;

positioning the barbell jack assembly in a pivot position by contacting a surface of the barbell jack device to a central shaft of the barbell and rotating the bottle such that a first bottom edge of the bottle that is horizontally closest to the central shaft of the barbell is contacting a ground surface and serving as a pivot point, the pivot point creating an angle greater than 50 degrees between the ground surface and a bottle side having the first bottom edge;

pivoting the barbell jack assembly with the barbell about the pivot point in a rotational direction that makes a second bottom edge opposite to the first bottom edge of the bottle contact the ground surface; and removing or adding weight plates to the end portion of the barbell.

19. The method of claim 18, wherein the first and second bottom edges are covered by a sleeve.

20. The method of claim 18, wherein the angle is between 65 to 75 degrees.

* * * * *